United States Patent [19]

Baillie et al.

[11] Patent Number: 4,715,669

[45] Date of Patent: Dec. 29, 1987

[54] CARTRIDGE CABINET DRAWER

[75] Inventors: William R. Baillie, Corona; Jorge Macias, West Covina; Michael Dressendorfer, San Dimas, all of Calif.

[73] Assignee: Russ Bassett Company, Whittier, Calif.

[21] Appl. No.: 879,416

[22] Filed: Jun. 27, 1986

[51] Int. Cl.[4] ..... A47B 81/06

[52] U.S. Cl. ..... 312/12; 312/319; 312/330 R; 211/40

[58] Field of Search ..... 312/9–14, 312/317 R, 320, 319, 330 R, 20; 211/40, 41; 206/387

[56] References Cited

U.S. PATENT DOCUMENTS

| | | | |
|---|---|---|---|
| 2,923,584 | 2/1960 | Broderick, Jr. | 312/317 |
| 3,811,745 | 5/1974 | Cylke | 312/319 X |
| 3,856,192 | 12/1974 | Nelson | 312/10 X |
| 3,862,787 | 1/1975 | Hilsinger | 312/319 X |
| 4,051,549 | 9/1977 | Fiege | 211/41 X |
| 4,415,079 | 11/1983 | Ackaret | 312/319 X |

*Primary Examiner*—Joseph Falk

*Attorney, Agent, or Firm*—George J. Netter

[57] ABSTRACT

One side of a cabinet drawer shelf is at least partially closed off to prevent storing access while the other side is open for storing microfilm cartridges or other items. A cartridge is of such dimensions as to extend outwardly from the shelf confines enabling ready access for removal and replacement. An elongated pressure exerting retention strip located in the top portion of each shelf is constructed of a flat sheet-like strip of a springlike material having a plurality of transfer slits therein. The strip lateral edges are confined in a pair of spaced apart grooves distending the strip to engage and hold cartridges on the shelf. In another version, a strip of a plastic foam is located on either the shelf top surface with a thin strip of a material having low frictional sliding surface thereon, such as Mylar, for example, being located thereover.

3 Claims, 12 Drawing Figures

CARTRIDGE CABINET DRAWER

The present invention relates generally to cabinet drawers and shelves, and, more particularly, to cabinet drawers especially adapted for storing items such as microfilm cartridges, or the like, in a manner allowing them to be readily retrieved without disturbing the order of storage.

BACKGROUND

A continuing problem in cabinet drawers which are to be utilized for containing a number of items stacked or arranged in a preferred order is that if the drawer is not filled, there is a tendency for the items to fall over or to slide down, making them difficult to retrieve and frequently causing them to be rearranged within the drawer. Also, especially if the items are packed very tightly within the drawer, individual retrieval is difficult due to frictional engagement with adjacent items.

Even if the items are stacked in a substantially upright condition initially, when one or more of them are removed, there is a tendency for the others to close up the space, thereby making it difficult to replace the items later in their proper location.

To overcome the indicated difficulties, it is well known to use compartments formed from fixed or removable divider walls between each item placed in the drawer or between predetermined groups of such items. However, the relatively high cost of such partitions is an inhibiting factor, and, as well, partitions limit the kind and shape of items that can be stored in the drawer.

It is also known to use what is sometimes termed as a follower consisting of an upright member which is movable along the drawer forming a releasable wall to support the items arranged within the drawer. This wall can be moved as desired to accommodate varying numbers of items However, to use a follower it is necessary to physically move it corresponding to the number of items in the drawer, and a follower still does not solve the problem of removing one or several items and then later replacing the items properly with respect to other items in the drawer.

OBJECTS AND DESCRIPTION OF A PREFERRED EMBODIMENT

It is a primary object and aim of this invention to provide an improved cabinet drawer construction which will secure items to be stored therein in a selective arrangement without the need for dividers or followers.

Another object is the provision of a cabinet drawer which maintains a predetermined arrangement of items therein upon removal of one or more of the items.

Still another object of the invention is the provision of a cabinet drawer construction which maintains items in the drawer in a fixed relation when subjected to normal shocks and vibrations experienced by the cabinet on opening and closing of the drawers.

In accordance with the practice of the present invention, a cabinet has one or more drawers for storage of such things as microfilm cartridges having outline dimensions of a predetermined substantially fixed character although perhaps of differing thicknesses. Each of the drawers includes a number of vertically arranged shelves. One side of each of the shelves is at least partially closed off to prevent storing access while the other side is open and via which the cartridge or other items to be stacked therein can be admitted. It is contemplated that the cartridges are to be stacked in a line along a shelf with the total shelf width from the open side to the partially closed side being slightly less than the cartridge dimension. Accordingly, when a cartridge is received on the shelf a portion extends outwardly beyond the shelf confines enabling ready access for removal and replacement.

An elongated pressure exerting retention member is located in the top portion of each shelf and extends longitudinally of the shelf. More particularly, the member is constructed of a number of consecutively adjacent spring-like members which in use will individually contact the top of cartridges resiliently holding them in place so that they may be individually removed without disturbing the others.

As a first form of the pressure exerting retention member, a flat sheet-like strip of a spring-like material has a plurality of transfer slits therein. When installed in a shelf, the strip lateral edges are confined in a pair of spaced apart grooves so that the strip central portion is distended outwardly forming a curved surface for engaging cartridges which are received therein. When in use, the cartridges have their upper edge secured by the strip and by virtue of the transverse slits, removal of any one or more cartridges allows the remaining cartridges to still be secured in place. Also the overall spring-like effect serves to maintain all of the items on the shelf during opening and closing of the cabinet drawer. Alternatively, the strip may be extruded in curved form and the slits subsequently cut therein.

As a further alternative embodiment, an elongated strip of a plastic foam is located on either the shelf lower base or the shelf upper or top surface with a thin strip of a material having low frictional sliding surface thereon, such as Mylar, for example, being located thereover.

DESCRIPTION OF PREFERRED EMBODIMENTS

Figure 1:
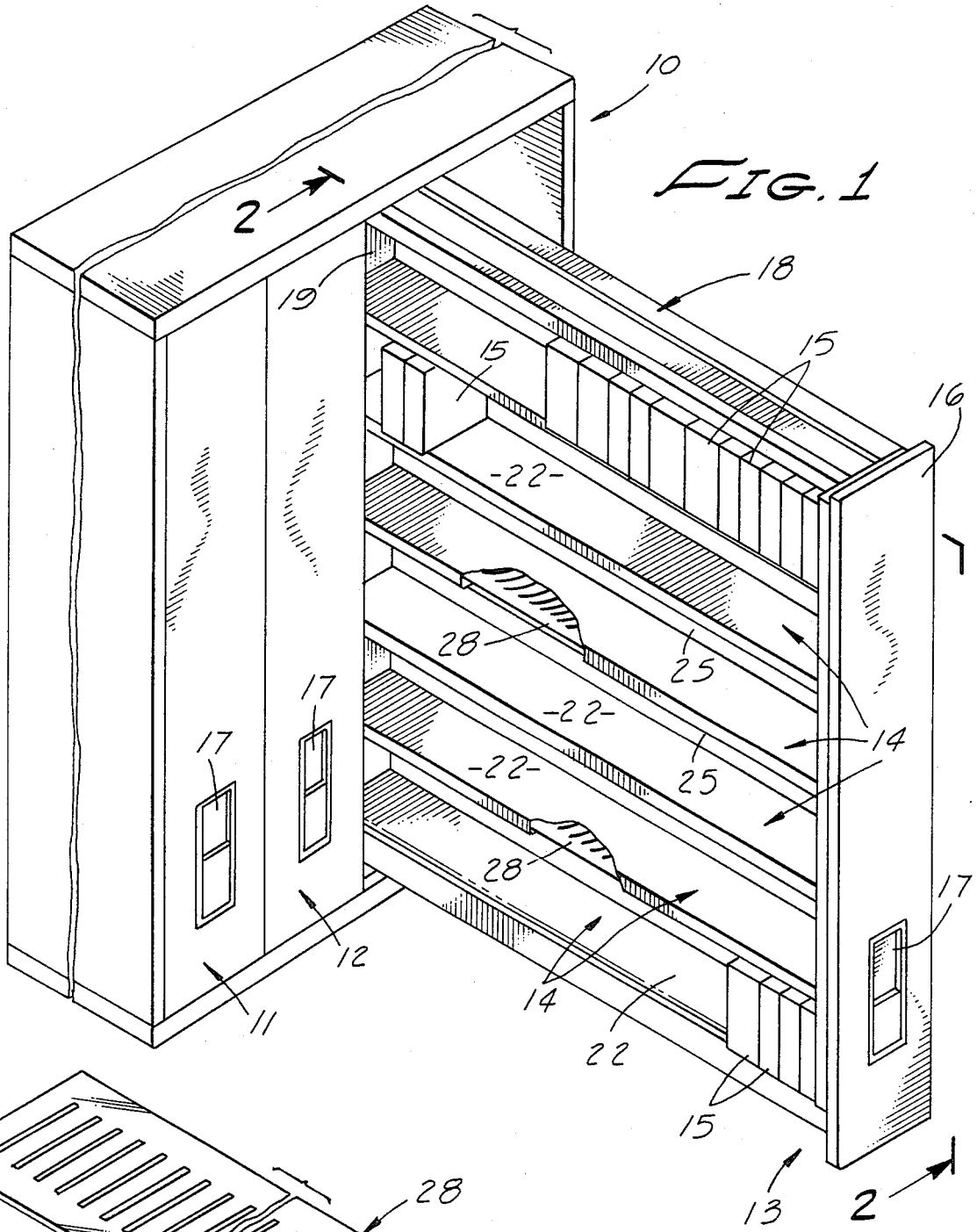
FIG. 1 is a perspective view of a cabinet showing one drawer constructed in accordance with the present invention extending from the cabinet.

Turning now to the drawings, and particularly FIG. 1, a filing cabinet 10 is seen to include a plurality of drawers 11 through 13 which are arranged in horizontally adjacent arrangement and which can be selectively pulled from out of the cabinet housing to provide access to the drawer contents. The drawer 13 which is shown in extended shelves 14 vertically arranged with respect to each other and access to which for inserting items to be stored or removing the same is from one side of the shelf. Each of the shelves 14 is substantially identical to every other shelf and therefore only the detailed construction of one such shelf will be given.

Although the present invention can be advantageously employed with drawer shelves to be described for storing items of great variety, they will be particularly described herein for the storage of microfilm cartridges which have an overall parallelpiped construction and have a common square geometry of approximately four inches on each side, although the thickness can vary. Moreover, although the microfilm cartridges may be stored in the shelves to be described in their natural condition or, optionally, roll film housed in a cardboard container of slightly smaller dimensions than the cartridge.

Figure 2:
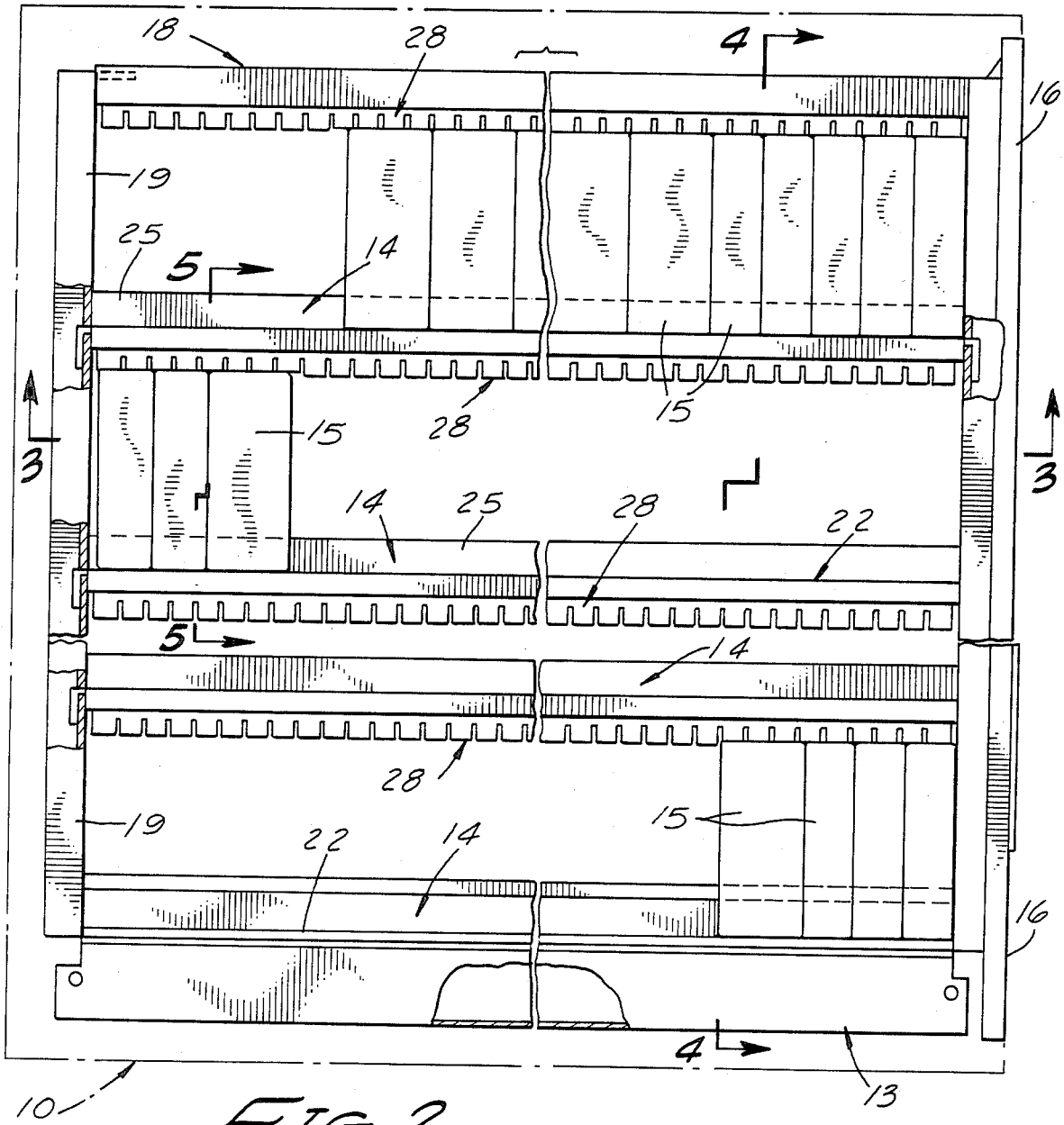
FIG. 2 is a side elevational, partially sectional view of the cabinet drawer taken along line 2—2 of FIG. 1.
Figure 3:
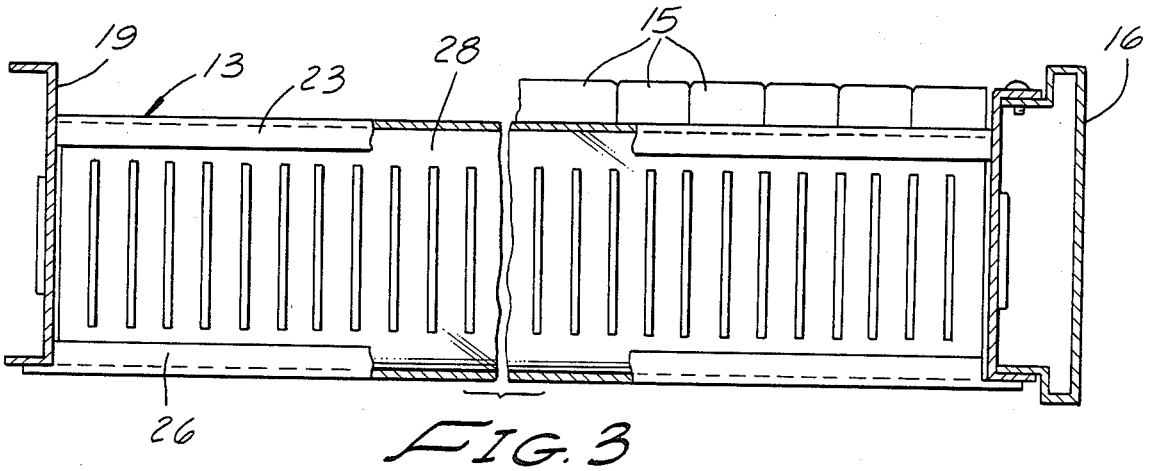
FIG. 3 is a plan, partially fragmentary view taken along line 3—3 of FIG. 2.
Figure 4:
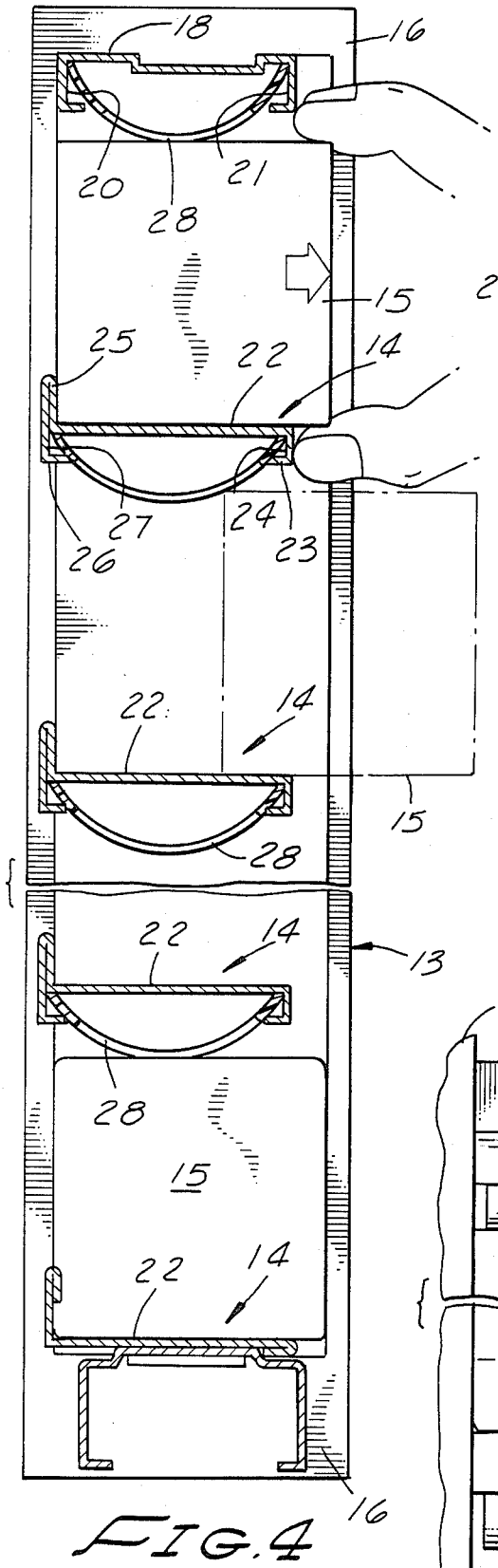
FIG. 4 is an end elevational view taken along line 4—4 of FIG. 2.

For the ensuing description of the drawer detailed construction, additional reference is made to FIGS. 2, 3 and 4. Each drawer 13 includes an outer rectangular panel 16 which encloses the drawer outer surface and includes a recessed hand hold 17 on its outermost surface for pulling the drawer outwardly from when it is enclosed within the cabinet 10. This drawer front panel 16 can be constructed solid in one piece or it may be, as shown in FIG. 3, of two pieces of sheet metal or sheet steel which are formed appropriately and interconnected by sheet metal screws, welded or by other fastening techniques.

The topmost shelf wall 18 is formed from an elongated generally rectangular metal member having both lateral edge portions formed at right angles in the same direction to the center portion and the terminal edges of each then formed again at right angles parallel to the center section and facing one another. The wall 18 has one end affixed to the front panel 16 and the opposite end affixed to a back panel 19, the latter being merely a rectangular metal sheet. When viewed in cross-section as shown in FIG. 4, the shelf wall 18 is closed at the top but has an opening in the lower part which is slightly less than the width of the wall and includes at each side recesses 20 and 21 for a purpose to be described. The transverse dimension or width of the topmost shelf wall 18 is slightly less than that of an item or article that is to be stored in the shelf. For example, in the case of a four inch microfilm cartridge, the width of the wall 18 is approximately ½ inch less than the cartridge width or about 3.5 inches overall.

A plurality of shelf panels 22 are arranged vertically aligned underneath the top wall 18 in an equally spaced apart relation that is slightly greater than the vertical dimension of a cartridge 15. The ends of each shelf panel are secured respectively to the front drawer panel 16 and rear panel 19.

A shelf panel 22 is formed from an elongated rectangular sheet of metal which has one lateral edge formed at 90 degrees to the main sheet and with the terminal edge portion thereof being turned back over and parallel to the main sheet to form an internal recess 24. The opposite lateral edge portion of the metal sheet is formed upwardly normal to the main central in a direction opposite to the turned over edge 23 forming an upstanding wall 25. At the uppermost extent of the wall 25 the metal edge portion is then turned in the opposite direction along the wall 25 to extend normally away from the main sheet blank in the same direction as the turned over edge 23. Finally, the terminal edge portion is then bent back parallel to the main sheet with the lateral sheet edge facing that of the turned over edge 23. The terminal edge portion 26 defines a recess 27 which faces the recess 24 on the opposite edge of panel 22.

To recapitulate on the drawer construction described to this point, there are a plurality of shelf panels 22 arranged parallel to one another and vertically aligned underneath a top panel 18 with the turned over edge portions 23 in one vertical plane and the upstanding walls 25 in a second vertical plane. The upper surface of each of panels 22 forms a supporting area for a shelf on which cartridges or other items to be stored rest. The upstanding partial wall 25 serves as a backstop to present a cartridge from falling out or being removed from the back side of the shelf.

Figure 7:
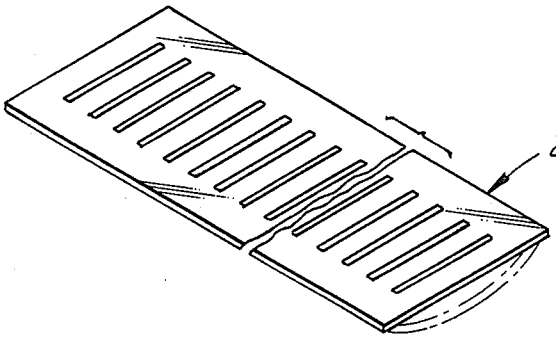
FIG. 7 is a perspective of a retention member shown removed from a drawer.

With reference now to FIG. 7, a retention member 27 is shown which consists of a rectangular strip of synthetic plastic which is resilient and spring-like. The length of the retention member strip is substantially the same as that of a shelf panel 22 or the top wall 18. The retention member has a width which exceeds that of the panel 22 and includes a plurality of spaced apart slots formed therein extending transversely of the member but terminating short of each lateral side so as to leave a band of imperforate material along each edge. As can be seen in FIG. 4, for example, the retention member has its lateral edges received within recesses 20 and 21 of top wall 18 or, recesses 24 and 27 of a panel 22, as the case may be. Accordingly, since the retention member is wider than the panel it bows downwardly to provide a curved spring-like member for a use to be described.

Figure 5:
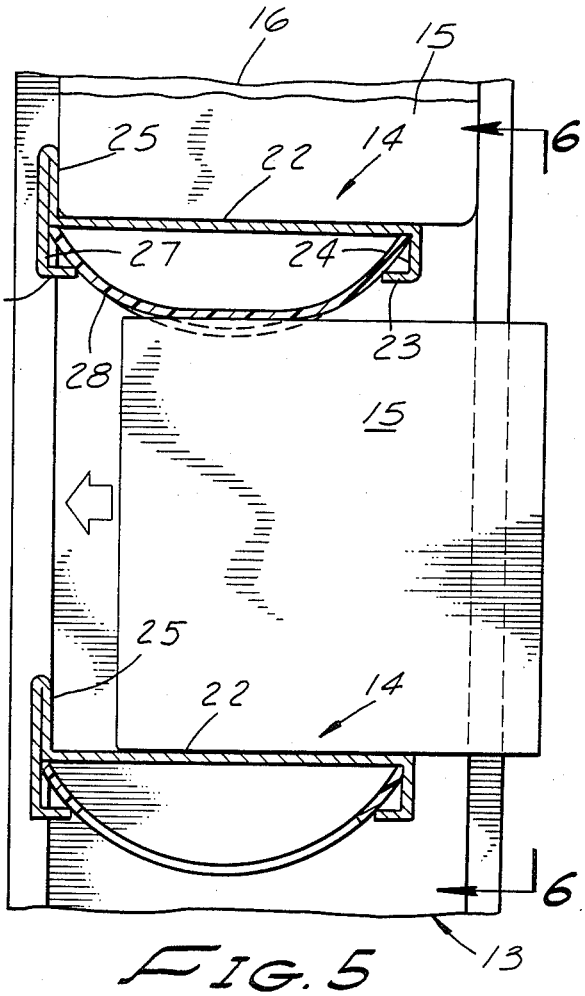
FIG. 5 is an enlarged view similar to FIG. 4 showing a cartridge partially inserted into the shelf storage area.

As shown best in FIG. 5, a cartridge 15 to be stored on the shelf 14 is merely slid from the open side of the shelf onto a panel 22 transversely of the panel until the far cartridge edge engages the upstanding wall 25 (FIG. 4). The dimensions of the spacing between two adjacent panels 22, or a panel 22 and the top wall 18, are such that the bowed out portion of the member 27 is compressed by the upper edge of the cartridge when it is fitted onto a shelf. Accordingly, in this manner there is a resilient downward pressure by the retention member 27 onto the top of the cartridge securely holding it in place on the shelf. Moreover, since the width of the panels 22 are less than that of the cartridge, there is a portion of the cartridge which extends outwardly from the open side of the shelf (FIGS. 1 and 4) which extending portion can be readily grasped and a cartridge removed from the shelf by simple finger gripping of the cartridge.

Figure 6:
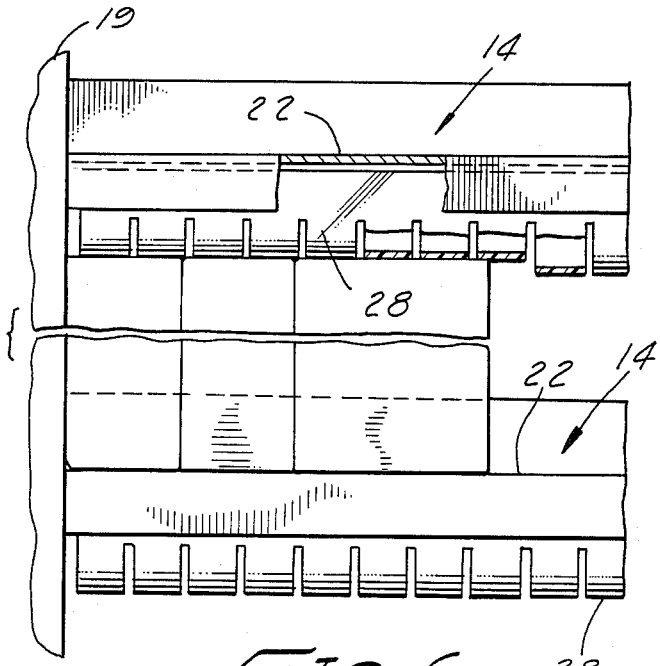
FIG. 6 is a view similar to FIG. 2 showing several different sized cartridges stored on the same shelf.
Figure 8:
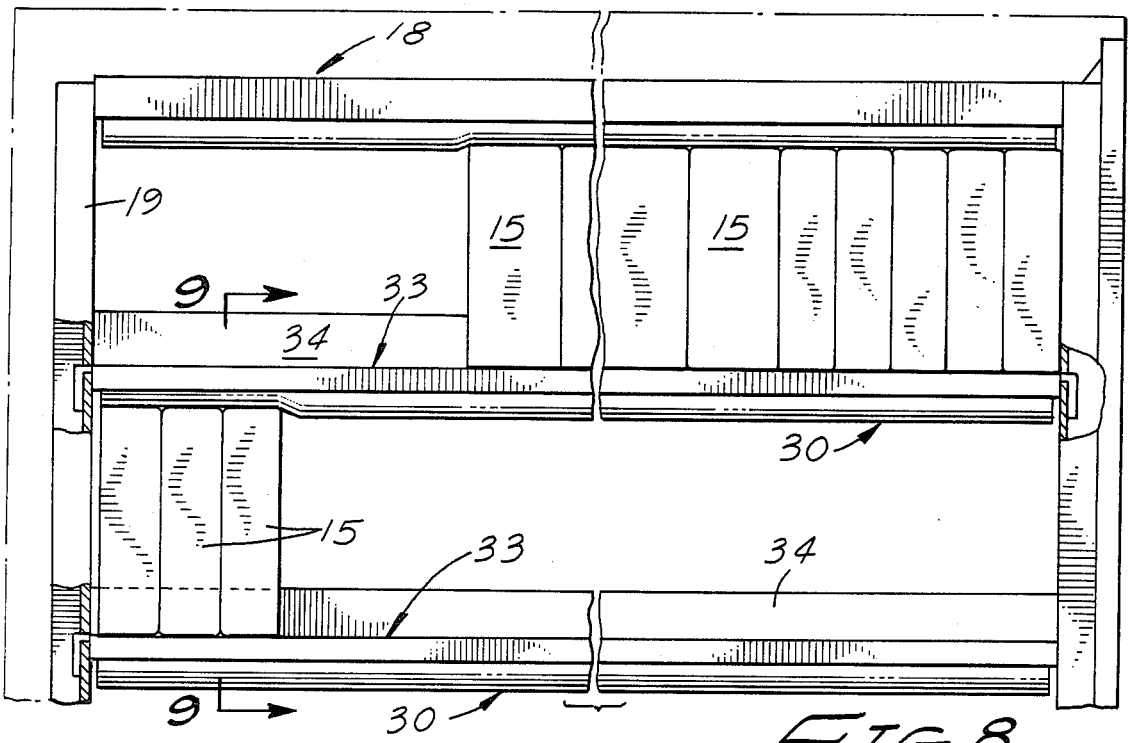
FIG. 8 is a side elevational, partially sectional view of a cabinet drawer with an alternative embodiment of retention member.
Figure 9:
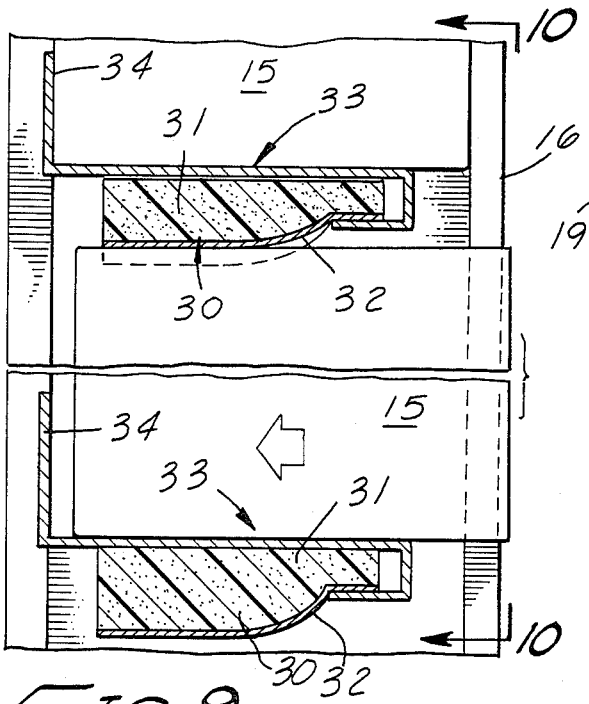
FIG. 9 is an end elevational view taken along 9—9 of FIG. 8.
Figure 10:
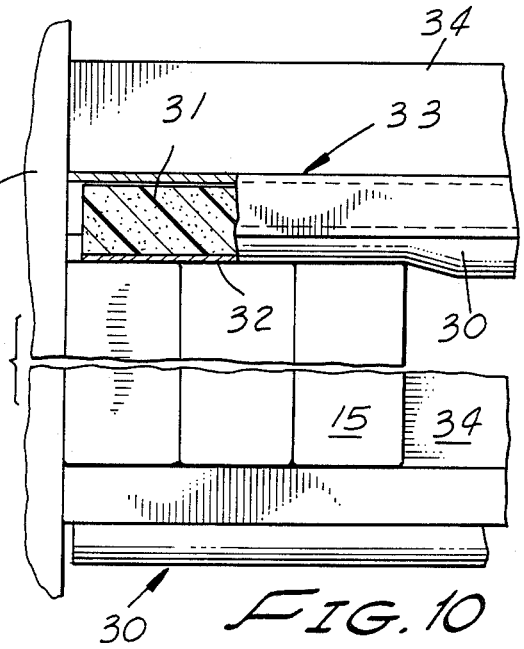
FIG. 10 is a side elevational sectional view taken along the line 10—10 of FIG. 9.
Figure 11:
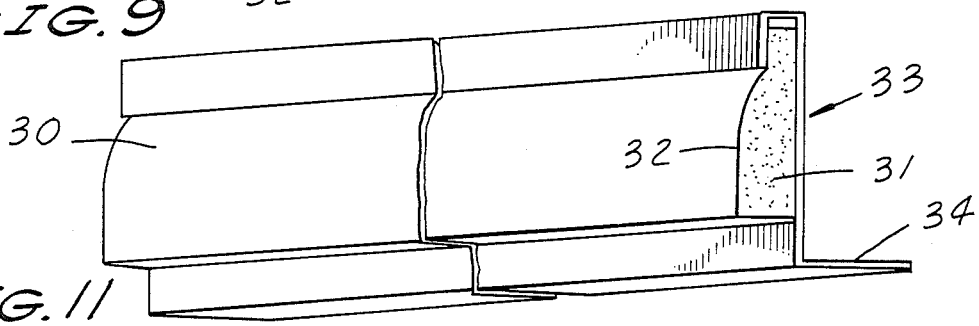
FIG. 11 is a perspective view of the alternative retention member used in FIG. 8.

Turning to FIG. 6, it is to be noted that as a result of the plurality of slots in the retention member, the retention member essentially consists of a large number of individual spring-like elements arranged along the member length and which can be individually compressed (FIG. 5) by a cartridge and at the same time adjacent portions of the retention member will be in extended relation. This is important in that if, for example, a cartridge is removed from a center portion of a stack of closely adjacent cartridges, the immediately adjacent cartridges are firmly held by the retention member and the space left by the removed cartridge still remains. Therefore, when it is desired to replace a cartridge in the stack on any particular shelf, the space can be easily found and in that way the possibility of replacing it in a wrong location is substantially reduced.

Moreover, in the event of a stack of cartridges being located on a shelf leaving an open shelf portion at the end, the retention member serves to still hold the cartridges in an upright manner without the need for followers or other means at the end of the stack. Also, the immediately adjacent portions of the retention member which are not compressed (FIG. 6) will also serve as securement against movement of the stack. It has been found that the retention member as described herein serves to hold even a partial stack in upright secured position despite repeated closing and opening of the drawer.

Figure 12:
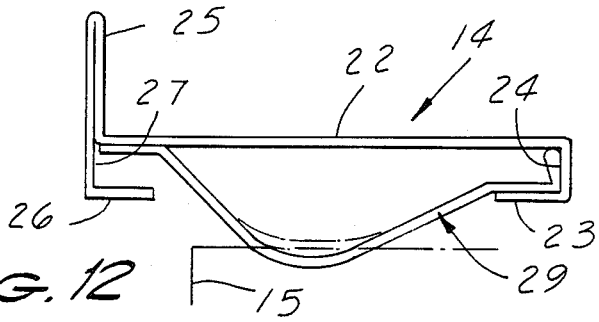
FIG. 12 is an alternative form of the invention.

Although the first described form of retention member 14 is constructed from a flat plastic sheet following which the slits therein are formed, it is contemplated as an alternative construction that the retention member may be made by extruding a plastic member having a preformed bow therein following which on the plastic setting up slits are then cut into the bowed portion. Such an alternative form is enumerated as 29 in FIG. 12.

For the ensuing description of a still further form of retention member enumerated generally as 30, reference is now made to FIGS. 8 through 11. This retention member consists of an elongated strip 31 of foam plastic of a length substantially equal to the entire length of a shelf panel to be described and of a width that is slightly less than the panel width. On one major surface of the foam plastic there is secured a suitable cementious material, for example, a thin film 32 of a material having very low sliding friction surface, such as the plastic known as Mylar.

For this form of retention member, the topmost shelf wall can be identical to the wall 18 in the first described embodiment. The other shelf panels must be differently configured however. Thus, as can be seen best in FIG. 9, each panel 33 can be made from a flat rectangular, elongated metal sheet having one transverse edge portion formed upwardly at 90 degrees thereto to form an upstanding rear wall 34. The opposite edge of the panel is turned under the central portion of the panel on the side opposite the wall 34 and an edge portion of the foam plastic strip 32 is clampingly secured therein. The vertical stacking arrangement of the panels and mutually spacing thereof are the same as in the first described embodiment. Accordingly, now, when a cartridge is inserted onto the shelf due to the spacing of the shelf panels, the upper edge of the cartridge compresses the foam plastic as it slides along the Mylar surface thereby producing a spring-like reaction that secures the cartridge or other item in place. As in the first described embodiment, removal of one or more cartridges from the shelf does not cause a lessening of the spring-like loading of the remaining cartridges and therefore the space from which a cartridge is removed remains so that the removed cartridge may be replaced with ease.

We claim:

1. A cabinet drawer for releasably storing a plurality of items of substantially identical height, comprising:

a front panel;

a back panel spaced apart from said front panel;

a top wall having one end secured to front panel and the opposite end secured to the back panel, said wall including a pair of inwardly facing spaced apart recesses on a lower surface;

a shelf panel having first and second opposite ends affixed to the respective front and back panels below the top wall a distance greater than the height of the items, said shelf panel having a width less than that of the items;

said shelf panel having an upstanding wall along one edge forming a partially enclosed back wall for the shelf panel the opposite side being open forming an access opening through which items are added to and removed from the drawer; and a flat sheet of deformable spring-like material having a width greater than the distance between the top wall recesses, said flat sheet having opposite edges received within the respective recesses effecting bowing of the sheet downwardly toward the shelf panel a sufficient amount to resiliently engage the top of an item located therein;

said flat sheet having a plurality of parallel transverse spaced apart slots therein forming between each adjacent pair of slots an individual resiliently deformable member.

2. A cabinet drawer as in claim 1, in which further shelf panels are affixed to the front and back panels in identical spaced apart relation, the lateral edge portions of each shelf panel being formed downwardly and toward each other forming spaced apart recesses on the shelf panel lower surface, and further flat sheets of deformable material received within the recesses of each shelf panel.

3. A cabinet drawer as in claim 1, in which the flat sheet is constructed of a synthetic plastic material molded into a bowed shape.

* * * * *